United States Patent [19]

Roberts et al.

[11] Patent Number: 4,673,058

[45] Date of Patent: Jun. 16, 1987

[54] HIGH PERFORMANCE AUTOMOTIVE MUFFLER

[75] Inventors: Peter Roberts, Mississauga; Sydney Chung, Willowdale, both of Canada

[73] Assignee: G Enterprises Limited, Rexdale, Canada

[21] Appl. No.: 861,525

[22] Filed: May 9, 1986

[51] Int. Cl.[4] ..... F01N 1/04

[52] U.S. Cl. ..... 181/266; 181/256; 181/272

[58] Field of Search ..... 181/248, 250, 265, 266, 181/272, 256

[56] References Cited

U.S. PATENT DOCUMENTS

| | | | |
|---|---|---|---|
| 2,041,767 | 5/1936 | Jack, 3rd | 181/248 |
| 2,088,296 | 7/1937 | Kingsley | 181/250 |
| 3,289,786 | 12/1966 | Powers | 181/266 |
| 3,389,764 | 6/1968 | Kelso | 181/266 |
| 3,741,336 | 6/1973 | Malosh | 181/266 |
| 4,381,045 | 4/1983 | Buchwalder | 181/265 |
| 4,467,887 | 8/1984 | Vizard | 181/265 |

*Primary Examiner*—Benjamin R. Fuller

*Attorney, Agent, or Firm*—Anthony J. Casella; Gerald E. Hespos

[57] ABSTRACT

A high performance vehicular muffler is provided. The muffler includes a centrally disposed outlet tube, an inlet tube and a transfer tube. Internal baffles define a low frequency tuning chamber with which the inlet tube and transfer tube communicate. A high frequency tuning chamber surrounds the portion of the outlet tube between the internal baffles. The high frequency tuning chamber is packed with an absorbant. The opposed end caps of the muffler are provided with outwardly bowed portions to achieve a more laminar flow of exhaust gases and to minimize back pressure.

11 Claims, 6 Drawing Figures

HIGH PERFORMANCE AUTOMOTIVE MUFFLER

BACKGROUND OF THE INVENTION

The principal object of an automotive exhaust muffler is to reduce the noise produced by exhaust gases to an acceptable level. There are several other requirements that compete with the noise reduction functions of an automotive exhaust muffler. In particular, the muffler is confined to a relatively small available space envelope on the underside of the vehicle. It becomes more difficult to attenuate noise in smaller mufflers. Another competing factor is the manufacturing cost. This often is an important factor in the highly competitive and mature exhaust industry. A third factor which competes directly with noise reduction is the effect of the muffler on engine performance. More particularly, mufflers inherently impede the flow of exhaust gases from the engine. This impedence creates a back pressure between the muffler and the engine, with a resulting negative effect upon the power production of the engine. Automotive engineers therefore must make design decisions that will achieve a selected noise level while minimizing back pressure and its effects on engine performance.

Many vehicle owners or operators are primarily concerned with the noise attenuation characteristics of an exhaust muffler. Performance penalties that may be associated with a muffler that achieves an acceptably quiet operation are considered to be less significant. Other vehicle owners or operators are primarily concerned with the performance characteristics of the exhaust muffler, and will tolerate somewhat higher noise levels.

Generally, the mufflers that stress improved engine performance are designed to provide a more direct flow path for exhaust gases in an effort to minimize back pressure. A typical high performance muffler includes opposed inlet and outlet ends with corresponding inlet and outlet tubes or nipples which extend into the body of the muffler. The typical prior art high performance muffler includes three internal chambers spaced along the length of the muffler. For purposes of this disclosure, the chambers nearest the inlet and outlet ends of the muffler will merely be referred to as the inlet end chamber and the outlet end chamber. These chambers often are referred to as flow chambers. The central chamber, as explained below, often is a low frequency tuning chamber. The inlet tube will extend through the inlet end chamber and the central chamber and will enter into the outlet end chamber. The inlet tube often will be of solid wall construction through the inlet end chamber but will be perforated in the central chamber of the muffler. The inlet tube typically is offset with respect to the longitudinal axis of the muffler. In a similar manner, the outlet tube will extend through the outlet end chamber and the central chamber of the muffler and will open into the inlet end chamber thereof. The outlet tube generally will be of solid wall construction in the outlet end chamber, but may be perforated in the central chamber of the muffler. The outlet tube typically is centrally located relative to the longitudinal axis of the muffler. A transfer tube is provided to provide communication between the inlet end chamber and the outlet end chambers, or the chambers disposed on opposite ends of the muffler. This transfer tube may also be of perforated construction as it extends through the central chamber of the muffler.

The central chamber of the prior art muffler often is packed with a sound absorbing material around the three perforated tubes extending therethrough. A typical sound absorbing material would be fiberglass. Absorbing packings such as fiberglass can be somewhat effective in reducing noise. However, the very hot exhaust gases flowing through the muffler at high speeds tends to break up the absorbing materials. In most applications the absorbant will literally be blown out of the exhaust system well within the anticipated structural life of the muffler. Thus, although the above described prior art high performance mufflers may provide acceptable noise levels when they are first installed, they will become increasingly noisy over time.

Other prior art high performance mufflers have attempted to reduce noise by varying the construction of the opposed heads or end caps of the muffler. The end caps define the respective longitudinal ends of the muffler through which the inlet and outlet pipes extend. In one prior art muffler, the opposed end caps defined a continuous arcuate structure disposed convexly outward. This construction was found to reduce the vibrations of the end caps and to reduce the noise associated with such vibrations. However, this construction often is considered to present certain manufacturing difficulties. More particularly, the convex outward end caps must be mated with a tubular sidewall. This mating must be structurally secure and typically is entirely mechanical, with no welding. It has been found that the arcuate end cap and the tubular sidewall can be difficult to connect. Similar difficulties may be encountered in securely connecting the tubular inlet or outlet pipe with the arcuate end cap.

Other prior art high performance mufflers have attempted to attenuate noise by mounting separate dish-shaped members to the inner surface of each opposed end cap. The dish-shaped members are intended to be of generally parabolic shape and are disposed such that the respective concave surfaces are inwardly facing. Each dish-shaped member further includes a generally annular support wall which extends from the rim of the dish toward the associated end cap of the muffler. These dish-shaped deflectors are purported to reflect the sound waves produced by the exhaust gases and to create an oppositely directed array of sound waves to cancel the principal array of sound waves. The ability of these dish-shaped deflectors to reliably cancel a significant portion of the oncoming sound waves is considered to be somewhat questionable. More particularly, the sound waves produced by the exhaust gases are not of a single frequency and wavelength but cover a fairly broad spectrum. Consequently, the dish-shaped deflectors can only be effective in cancelling a very narrow range of the sound produced by the exhaust gases. Furthermore, the dish-shaped deflectors extend outwardly from the associated muffler end caps and create an irregular internal surface for the muffler. This surface is believed to create turbulence with a somewhat negative effect on back pressure and engine performance. Furthermore, this additional turbulence is not believed to be engineered in a manner that will create a noise attenuation effect. In addition to the above described functional deficiencies of the dish-shaped deflectors, it is apparent that these structures add significantly to the manufacturing costs and time.

Certain prior art mufflers that are engineered primarily for their noise attenuation attributes rather than for high performance are known to include a plurality of internal chambers of varying dimensions. The varying size chambers each have their own noise attenuation characteristics. More particularly, the small chambers tend to be effective in attenuating high frequency noises, while the larger chambers tend to be effective in attenuating low frequency noises. The prior art high performance mufflers generally have not been provided with these various chambers. Rather, as explained above, the prior art high performance mufflers have primarily been engineered to yield a fairly direct air flow path with minimum back pressure.

In view of the above, it is an object of the subject invention to provide an improved high performance automotive muffler.

It is another object of the subject invention to provide a high performance muffler with an enhanced ability to attenuate sound produced by exhaust gases passing therethrough.

It is an additional object of the subject invention to provide an automotive muffler that will substantially reduce back pressure produced by the muffler.

Another object of the subject invention is to provide a high performance muffler with an enhanced ability to attenuate high frequency sounds.

Still another object of the subject invention is to provide a high performance muffler that can be manufactured efficiently and inexpensively.

SUMMARY OF THE INVENTION

The muffler of the subject invention is of elongated configuration with a tubular outer shell defining a generally eliptical cross section. The opposed end caps of the muffler are disposed generally parallel to one another and also are of generally eliptical shape. Both end caps are provided with generally circular apertures extending therethrough. The aperture in at least one end cap may be offset relative to the centerline of the muffler, while the aperture in the other end cap may be centrally disposed.

Pipes or nipples are fixedly mounted to the opposed muffler end caps at the respective apertures therein. Typically an offset nipple will define the inlet end of the muffler or the end closest to the engine and to which the exhaust pipe is connected. The centrally disposed nipple typically will define the outlet end of the muffler or the end furthest from the engine and to which the tail pipe is connected.

The inside of the muffler includes a pair of baffles, which may be disposed substantially parallel to the opposed end caps of the muffler and which define three enclosed chambers within the muffler. Specifically, the baffles define an inlet end flow chamber adjacent the inlet end cap, an outlet end flow chamber adjacent the outlet end cap and a central low frequency tuning chamber. The sizes of the chambers may be varied in accordance with the performance characteristics of the engine. Typically, however, the center chamber of the muffler will be slightly larger than either end chamber.

The inlet pipe of the muffler will extend generally parallel to the longitudinal axis of the muffler through its associated end cap and through both internal baffles of the muffler. Thus, the in-flow pipe will enable exhaust gases to flow into the outlet end flow chamber. However, the portion of the inlet tube between the two internal baffles of the muffler may be perforated or louvered to allow limited communication between the inlet tube and the central low frequency tuning chamber of the muffler. These perforations or louvers contribute to the sound attenuation of the muffler.

The muffler also is provided with a transfer tube extending generally parallel to the centerline of the muffler and providing direct communication between the opposed inlet end and outlet end flow chambers of the muffler. The transfer tube preferably is offset from the centerline of the muffler a distance substantially equal to the offset of the inlet tube. The transfer tube also preferably is perforated or louvered along its length to provide controlled communication to the central low frequency tuning chamber of the muffler. This limited communication by the perforations or louvers contributes to the noise attenuation. The combination of the inlet tube and the transfer tube provides for a primary flow of exhaust gas through the inlet nipple and inlet tube combination, into the outlet end flow chamber, then through the transfer tube and into the inlet end flow chamber.

The muffler further includes an outlet tube which extends from the outlet nipple to the inlet end flow chamber of the muffler. More particularly, the combination of the outlet nipple and outlet tube extends through the outlet end cap of the muffler and through both internal baffles. Thus, the outlet tube provides for the completion of the flow of exhaust gases from the muffler. Specifically, the exhaust gases which flow through the transfer tube and into the inlet end flow chamber of the muffler continue the flow through the outlet tube and ultimately through the outlet nipple.

The portion of the outlet tube between the internal baffles is perforated or louvered. However, the portion of the outlet tube intermediate the internal baffles may be surrounded by a solid wall tubular structure extending between the internal baffles and defining a high frequency tuning chamber. As explained above, the limited space available for the muffler imposes significant constraints on the engineering design options. Furthermore, as explained above, the competitive nature of the market and the relatively low price of the product requires a conscious effort to minimize the costs of materials and manufacturing. The subject high frequency tuning chamber can be provided within the existing space and cost limitations. More particularly, it has been found that the high frequency tuning chamber can be formed from a standard tubular member having an initially circular cross section. This tubular member then is flattened into an eliptical cross section. The eliptical tube is mounted over the perforated portion of the outlet tube and the opposed ends are pinched inwardly to provide a mechanical interconnection that adequately prevents the escape of gas therefrom. This formation of the high frequency tuning chamber can be carried out efficiently and inexpensively with available materials and manufacturing equipment. The high frequency tuning chamber then is mounted in the muffler such that the long cross-sectional axis of the eliptical high frequency tuning chamber is aligned orthogonal to the long axis of the eliptically cross-sectioned muffler. This unique configuration enables the presence of an efficiently dimensioned high frequency tuning chamber within the very limited space available in what would otherwise have been devoted entirely to a low frequency tuning chamber. Consequently, the subject high performance muffler is provided with both low and high frequency tuning chambers within a very small space envelope. Furthermore, the subject high frequency tuning chamber can be provided easily with available materials and available manufacturing equipment.

Preferably, the space intermediate the outlet tube and the high frequency tuning chamber is packed with a sound absorbant material, such as fiberglass. The fiberglass will at least initially contribute to the sound attenuation of the muffler. However, as noted above, the absorbant may eventually be destroyed and blown from the muffler by the high velocity heated exhaust gases. Even if the absorbing material is rendered ineffective, the high frequency tuning chamber will remain intact and will continue to function. Consequently, whereas the prior art high performance mufflers relied substantially upon the absorbing materials, the subject muffler relies to a greater extent upon the presence of both a high frequency tuning chamber and a low frequency tuning chamber within a small available space envelope. These tuning chambers will continue to function efficiently even if the fiberglass is eventually destroyed. Thus, the muffler will be effective in dampening both high frequency and low frequency noises.

As noted previously, the opposed end caps of the muffler are generally parallel to one another and are mechanically connected to the outer shell or wrapper of the muffler. The end caps also are provided with appropriately located apertures for the inlet and outlet nipples. In the typical application, the inlet nipple will be offset from the centerline, while the outlet nipple will be disposed substantially along the centerline. To contribute to an efficient flow of exhaust gases and to thereby reduce back pressure, the end caps are provided with outwardly bowed sections stamp formed therein. More particularly, the outlet end cap is provided with a generally circular outwardly bowed portion substantially directly opposite the internal end of the inlet tube. This outwardly bowed portion of the end cap will contribute to the directional change of the exhaust gases passing from the inlet tube through the flow chamber and into the transfer tube. This outwardly bowed configuration includes no internal structure within this flow chamber. Consequently, there are no internal structures to contribute to additional turbulence within this flow chamber and a resulting increase in back pressure. Furthermore, the simple stamping of the end caps to define the outwardly bowed portion can be carried out at substantially less cost than the prior art mufflers which included a separate internal structure secured to the inner surface of the end cap. The outlet end cap may also include an outwardly bowed portion substantially opposite the transfer tube. This outwardly bowed portion is believed to be somewhat less significant than the outwardly bowed portion opposite the inlet tube. However, the outwardly bowed portion opposite the transfer tube will contribute somewhat to the efficient flow of the swirling gases within the flow chamber toward the transfer tube. Furthermore, in certain situations the muffler will be reversed to accommodate certain unique design constraints of the vehicle. In these instances the gas flow will be reversed and the second outwardly bowed portion of the outlet end cap will be more important.

The inlet end cap also is provided with an outwardly bowed portion. This outwardly bowed portion contributes to the efficient flow of exhaust gases from the transfer tube through the flow chamber and into the outlet tube. Preferably, the outwardly bowed portion on the inlet end cap is at least partly opposite both the transfer tube and the outlet tube. In a preferred embodiment, explained further below, the outwardly bowed portion will be of generally elongated arcuate shape and will be of smaller depth and cross section at the portion thereof opposite the outlet tube. Thus, this outwardly bowed portion will effectively be of "teardrop" shape. This unique shape contributes efficiently to the redirection of the exhaust gases flowing from the transfer tube to the outlet tube.

DETAILED DESCRIPTION OF THE PREFERRED EMBODIMENT

Figure 1:
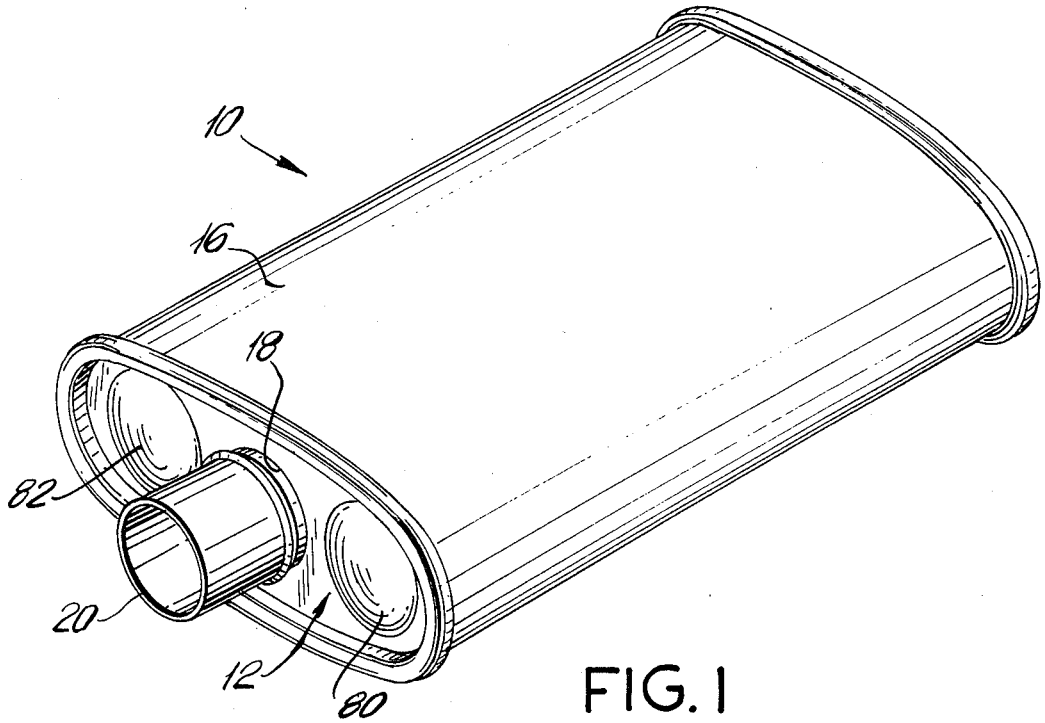
FIG. 1 is a perspective view of the muffler of the subject invention showing the outlet end thereof.
Figure 2:
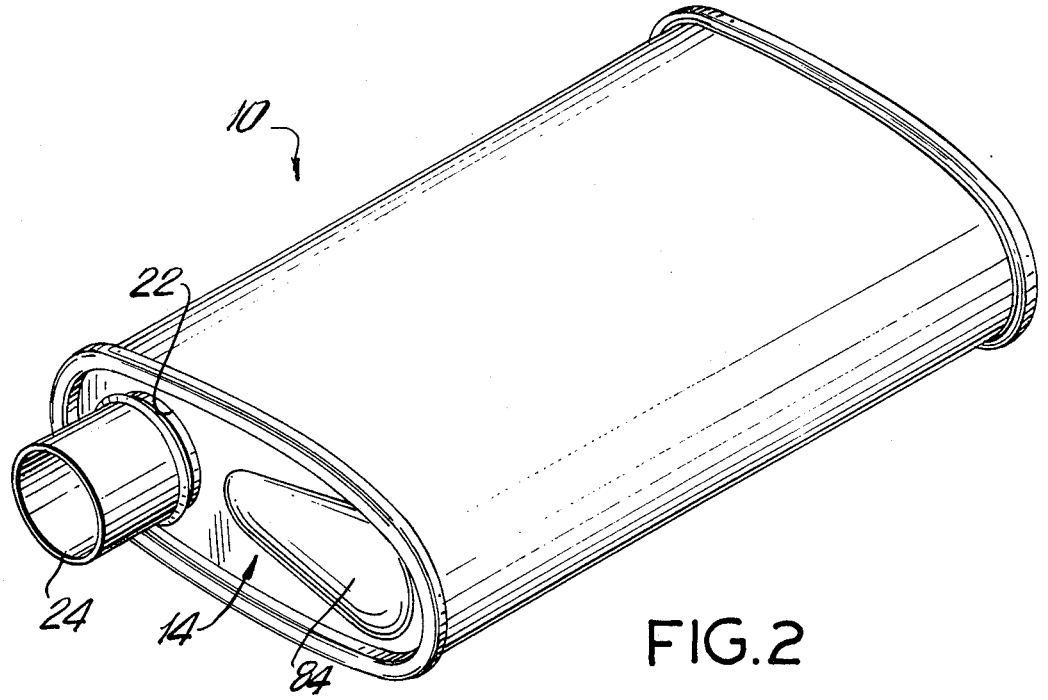
FIG. 2 is a second perspective view of the muffler of the subject invention showing the inlet end.

The high performance muffler of the subject invention is indicated generally by the numeral 10 in FIGS. 1 and 2. The muffler 10 is a generally elongated structure having an outlet end cap 12 as shown in FIG. 1 and an inlet end cap 14 as shown in FIG. 2. The outlet and inlet end caps 12 and 14 are of generally eliptical shape and are disposed generally parallel to one another and generally orthogonal to the centerline of the muffler 10. An outer shell 16 defines the outer surface of the muffler 10. More particularly, the outer shell 16 defines an elongated tube of eliptical cross section, the opposed ends of which are connected respectively to the opposed outlet and inlet end caps 12 and 14. The connection between the outer shell 16 and the outlet and inlet end caps 12 and 14 preferably is mechanical, and is formed by an interlocking of the respective edges.

The outlet end cap 12 of the high performance muffler 10 is provided with a generally centrally disposed circular aperture 18 through which a tubular outlet nipple 20 extends. The outlet nipple 20 will be connected to the tail pipe of the vehicle on which the muffler 10 is mounted. Similarly, as shown in FIG. 2, the inlet end cap 14 includes a generally circular aperture 22 through which a tubular inlet nipple 24 extends. However, the inlet nipple 24 is offset relative to the centerline of the muffler 10. The inlet nipple 24 will be connected to the exhaust pipe of the vehicle.

Figure 3:
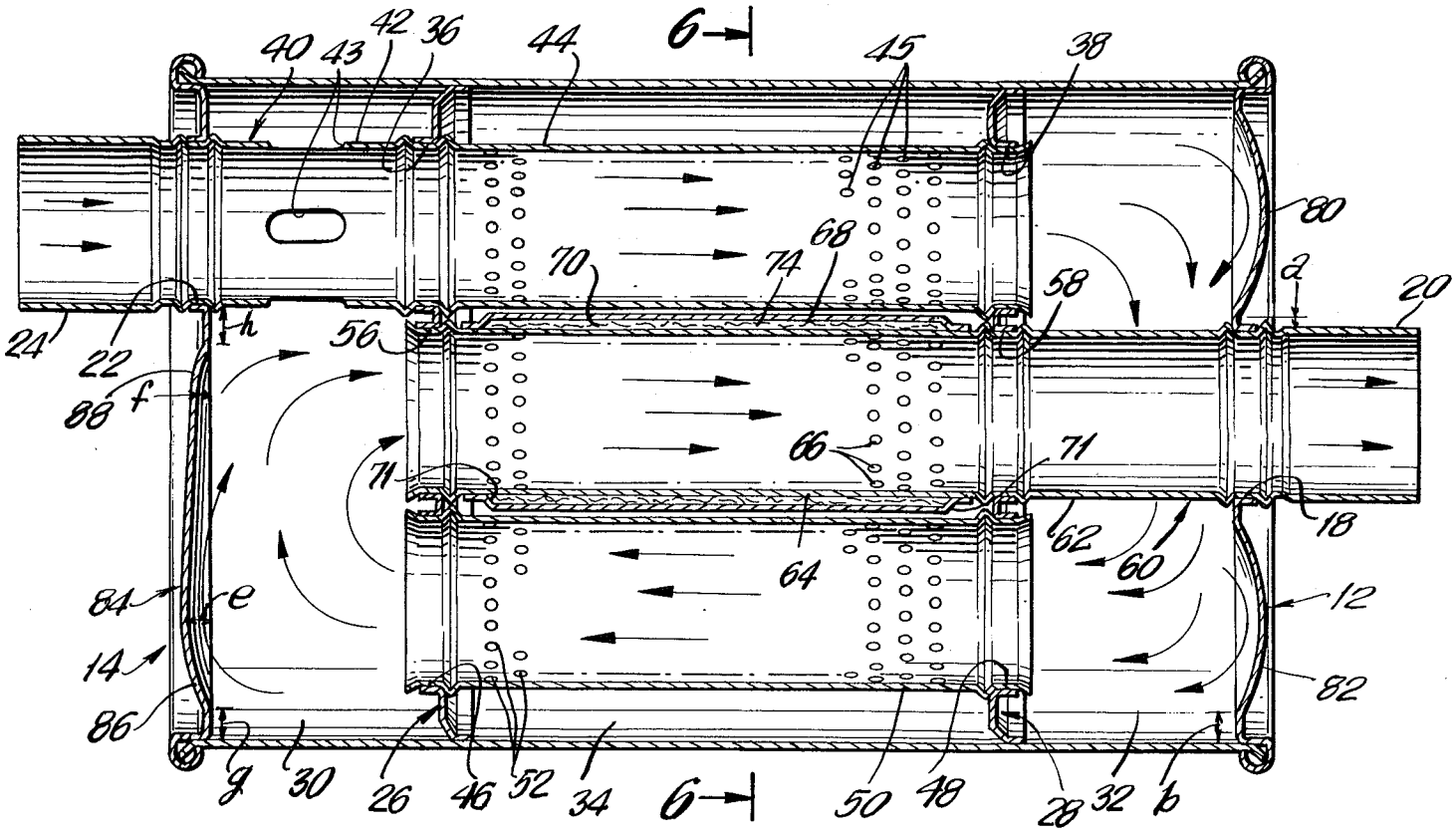
FIG. 3 is a cross-sectional view of the muffler of the subject invention.
Figure 4:
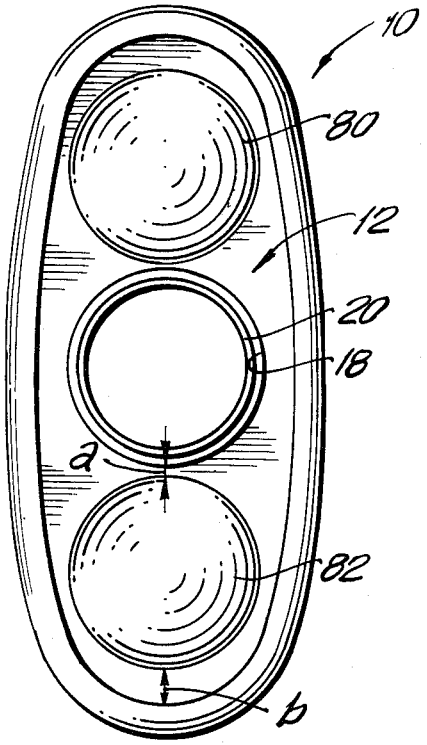
FIG. 4 is an end view of the outlet end muffler of the subject invention.
Figure 5:
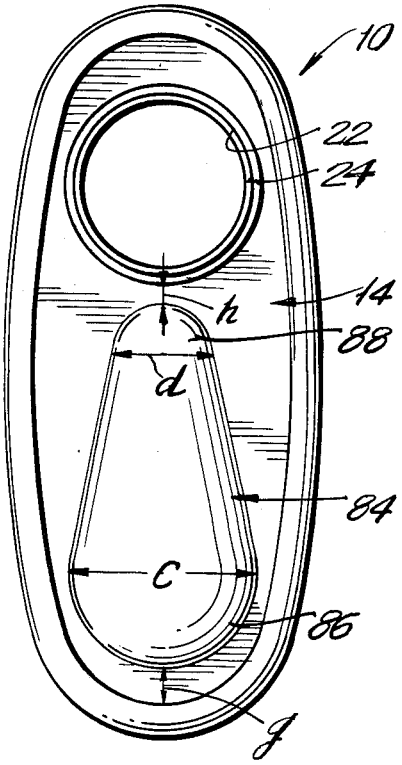
FIG. 5 is a second end view of the inlet end muffler of the subject invention.

The internal construction of the muffler 10 is illustrated in FIG. 3. More particularly, the muffler 10 includes internal baffles 26 and 28 which are of generally the same eliptical cross-sectional configuration as the opposed inlet and outlet end caps 14 and 12 respectively. More particularly, the internal baffles 26 and 28 are disposed parallel to the inlet and outlet end caps 14 and 12 and are mounted in supporting contact with the outer shell 16 of the muffler. By this construction, an inlet end flow chamber 30 is defined intermediate the inlet end cap 14 and the internal baffle 26. Similarly, an outlet end flow chamber 32 is defined intermediate the outlet end cap 12 and the internal baffle 28. Furthermore, a low frequency tuning chamber 34 is defined intermediate the baffles 26 and 28.

The internal baffles 26 and 28 are provided respectively with apertures 36 and 38 which are disposed in an off center position relative to the centerline of the muffler 10, but which are generally aligned with the aperture 22 in the inlet end cap 14. The inlet nipple 24 extends through the aperture 22 in the inlet end cap 14 and defines an inlet tube 40 inside the muffler 10. The inlet tube 40 extends through the apertures 36 and 38 in the baffles 26 and 28 respectively. The portion 42 of the inlet tube 40 disposed within the flow chamber 30 includes a plurality of tuning apertures 43. The portion 44 of the inlet tube 40 within the low frequency tuning chamber 34 includes a plurality of perforations or louvers 45. The size and density of the louvers 45 are selected to achieve the desired attenuation of low frequency noise produced by the exhaust gases passing through the inlet tube 40.

The internal baffles 26 and 28 are provided with apertures 46 and 48 respectively. The apertures 46 and 48 are off center an amount substantially equal to the off center alignment of the apertures 36 and 38. A transfer tube 50 extends between the baffles 26 and 28 and is connected thereto at the respective apertures 46 and 48. Thus, the transfer tube 50 provides for communication between the outlet end flow chamber 32 and the inlet end flow chamber 30. The transfer tube 50 also is provided with an array of perforations or louvers 52, the size and density of which is selected to achieve the preferred low frequency noise attenuation.

The baffles 26 and 28 also are provided with apertures 56 and 58 respectively, which are centrally aligned with the aperture 18 in the outlet end cap 12. The outlet nipple 20 extends into the internal portion of the muffler and defines an outlet tube 60 therein. More particularly, the outlet tube 60 includes a portion 62 of solid wall construction disposed within the outlet end flow chamber 32. Additionally, the portion 64 of the outlet tube 60 disposed intermediate the baffles 26 and 28 is defined by an array of perforations 66.

The portion 64 of the outlet tube 60 between the baffles 26 and 28 is surrounded by a solid wall generally tubular structure 68 which defines a high frequency tuning chamber 70 intermediate the tubular member 68 and the portion 64 of outlet tube 60. More particularly, the tubular member 68 is provided with pinches 71 adjacent the opposed ends thereof to achieve a secure interfit with the outlet tube 60 adjacent the baffles 26 and 28 respectively.

Figure 6:
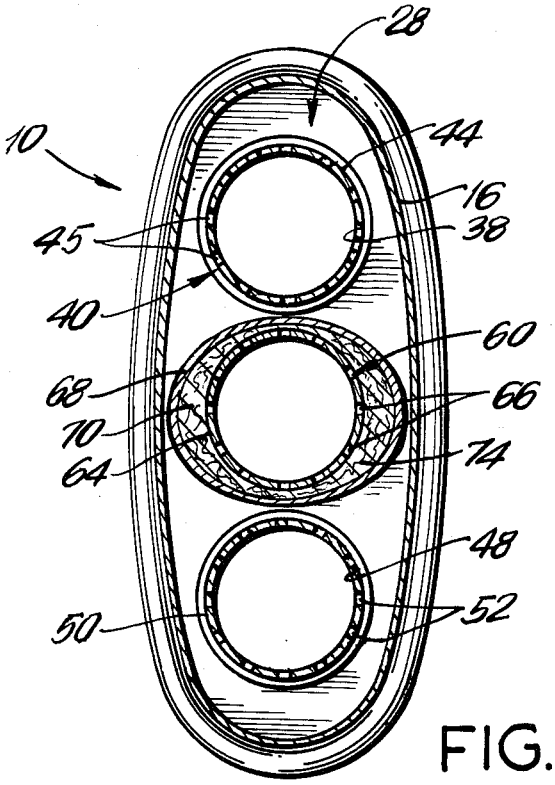
FIG. 6 is a cross-sectional view taken along line 6—6 in FIG. 3.

As shown clearly in FIG. 3, the required dimensions of the inlet tube 40, the transfer tube 50 and the outlet tube 60 provide little space intermediate the portions of the respective tubes disposed within the low frequency tuning chamber 34. Therefore, to achieve an effective volume for the high frequency tuning chamber 70, the tubular member 68 is formed to have a generally eliptical cross section as shown in FIG. 6. The long axis of the eliptically cross-sectioned tubular member 68 is aligned orthogonal to the long axis of the eliptically cross-sectioned muffler 10. Thus, the short axis of the eliptically cross-sectioned tubular member 68 will fit within the very limited space between the inlet tube 40 and the transfer tube 50. The long axis of the eliptically cross-sectioned tubular member 68 will be able to extend substantially the entire distance toward the opposed surfaces of the outer shell 16. This greater height of the eliptical tubular member 68 enables an effective volume for the high frequency tuning chamber 70.

The volume of the high frequency tuning chamber 70 is packed with a sound absorbing material 74, such as fiberglass. The fiberglass will contribute to the sound attenuation performance of the muffler 10 for at least the initial part of the life of muffler 10. As noted previously, the high volume of hot exhaust gases passing through muffler 10 tends to break down the known sound absorbing materials. As a result, sound absorbing materials such as the absorbant packing 74 may eventually be drawn through the apertures 66 and blown from the muffler. However, with the above described construction, the high frequency tuning chamber 70 will remain effective even if all of the absorbing material 74 is evacuated therefrom. Thus, the muffler 10 will have a low frequency tuning chamber 34 and a high frequency tuning chamber 70 its entire life.

As shown by the arrows in FIG. 3, the exhaust gases travel from the engine through the exhaust pipe and into the inlet nipple 24. These gases will flow through the inlet tube 40 and toward the outlet end flow chamber 32. The exhaust gases will then circulate through the outlet end flow chamber 32 and into the transfer tube 50. The transfer tube 50 provides for the communication of the exhaust gases between the outlet end flow chamber 32 and the inlet end flow chamber 30. As the exhaust gases move through the portion 44 of inlet tube 40 and through the transfer tube 50, a limited amount of fluid communication is enabled through the respective perforations 45 and 52 into the low frequency tuning chamber 34. As noted previously, the dimensions of the low frequency tuning chamber and of the perforations 45 and 52 are selected to achieve the desired low frequency sound attenuation. The exhaust gases leaving the transfer tube 50 will swirl through the inlet end flow chamber 30 and eventually into the outlet tube 60 to flow toward the exhaust pipe of the vehicle. The movement of the exhaust gases through the portion 64 of the outlet tube 60 will enable high frequency sound attenuation.

The exact flow pattern of exhaust gases in the flow chambers 30 and 32 is not known precisely. However, it is known that the precise flow patterns within the flow chambers 30 and 32 will vary in accordance with engine operating speeds and condition. It also is known that a substantial amount of turbulence and swirling action occurs as the exhaust gases move through the flow chambers 30 and 32. This turbulence can increase the back pressure produced by the muffler, and can thereby affect engine performance. On the other hand, back pressure can be reduced and engine performance improved if the flow of exhaust gases through the flow chambers 30 and 32 can be made more laminar.

A more laminar exhaust gas flow is achieved in the outlet end flow chamber 32 of the subject high performance muffler 10 by an outwardly bowed portion 80 in the outlet end cap 12 generally opposite the inlet tube 40. The outwardly bowed portion 80 is stamp formed in the outlet end cap 12 and defines a generally spherical section with a diameter equal to or greater than the diameter of the inlet tube. More particularly, this outwardly bowed portion contributes to the directional change that must occur in the exhaust gases exiting the inlet tube 40.

Some swirling of exhaust gases will continue to occur as the exhaust gases encounter and bypass the portion 62 of outlet tube 60 disposed in the outlet end flow chamber 32. To further contribute to the laminar flow of exhaust gases in the outlet end flow chamber 32, a second outwardly bowed portion 82 is stamp formed therein. The outwardly bowed portion 82 is substantially identical to the outwardly bowed portion 80 described above. In a typical installation of muffler 10, it is believed that the outwardly bowed portion 82 will have a somewhat smaller effect on air flow than the outwardly bowed portion 80. However, in some situations, the muffler 10 may be installed in a reversed position to accommodate unique space limitations on the vehicle. On these installations, the outwardly bowed portion 82 will be more important in achieving the desired laminar flow through the outlet end flow chamber 32.

The outwardly bowed portions 80 and 82 are spaced from the outlet nipple 20 by a distance "a" which typically is 0.25 inch or more. Similarly, the outwardly bowed portions 80 and 82 are spaced from the outer shell 16 by a distance "b" of approximately 0.375 inch or more. This spacing insures that the mechanical connections of the outlet end cap 12 to the outer shell 16 and to the outlet nipple 20 are not complicated by the presence of an arcuate surface.

The inlet end cap 14 is provided with outwardly bowed portion 84 which is functionally similar to the outwardly bowed portions 80 and 82 described with reference to the outlet end cap 12. More particularly, the outwardly bowed portion 84 will contribute to a laminar directional change of exhaust gases flowing from the transfer tube 50 through the inlet end flow chamber 30 and into the outlet tube 60. The outwardly bowed portion 84 is of generally elongated "teardrop" shape such that the end 86 thereof opposite the transfer tube 50 is larger than the end 88 thereof opposite the outlet tube 60. More particularly, the end 86 of the outwardly bowed portion 84 defines a diameter "c" of approximately 3.00 inches, while the end 88 thereof defines a diameter of "d" of approximately 1.50 inches or about one-half the diameter at end 86. Furthermore, the end 86 is approximately 0.375 inch deep, as indicated by dimension "e" while the end 88 is approximately 0.188 inch deep as indicated by dimension "f" or about one-half the depth at end 86. This unique configuration has been found to be particularly effective in achieving a laminar flow of exhaust gases from the transfer tube 50 to the outlet tube 60. To facilitate the assembly of the muffler 10, the outwardly bowed portion 84 is spaced distance "g" of approximately 0.375 inch from the outer shell 16. Similarly, the outwardly bowed portion 84 is spaced distance "h" of approximately 0.50 inch from the inlet tube 20. Thus, as explained above, the mechanical interconnections do not have to account for the mating of arcuate surfaces to one another.

In summary, a high performance muffler is provided which achieves a desirably low back pressure and acceptably low noise levels. The muffler includes opposed inlet and outlet end caps and a generally eliptically cross-sectioned outer shell. A pair of internal baffles are disposed in spaced relationship inside the muffler to define opposed inlet end and outlet end flow chambers and a low frequency tuning chamber therebetween. An inlet tube extends through the inlet end cap and through both internal baffles in an off center alignment to provide fluid communication from the engine of the vehicle to the outlet end flow chamber. A transfer tube connects the two flow chambers. The portions of the inlet tube and the transfer tube which pass through the low frequency tuning chamber are perforated. An outlet tube extends through both internal baffles and the outlet end cap to provide fluid communication between the inlet end flow chamber and the tail pipe of the vehicle. The portion of the outlet tube disposed between the baffles is perforated and is surrounded by a generally tubular member which defines a high frequency tuning chamber. The high frequency tuning chamber is of eliptical cross section, and has its long cross-sectional axis disposed orthogonal to the long axis of the eliptically cross-sectioned muffler. The high frequency tuning chamber is packed with a sound insulating material. The outlet end cap is provided with generally spherical outwardly bowed portions disposed opposite the inlet tube and the transfer tube. The inlet end cap is provided with an outwardly bowed arcuate portion opposite both the transfer tube and the outlet tube. The outwardly bowed portions achieve a more laminar flow of exhaust gases through the flow chambers, thereby achieving a lower back pressure.

While the invention has been described relative to a preferred embodiment, it is apparent that various changes can be made without departing from the scope of the invention as defined by the appended claims.

What is claimed is:

1. A high performance exhaust muffler for a vehicle, said muffler comprising opposed generally eliptical inlet and outlet end caps disposed in spaced parallel relationship, an outer shell extending between and connected to said end caps and defining a generally eliptical cross section and defining orthogonally disposed long and short cross-sectional axes, a pair of spaced apart generally eliptical internal baffles disposed intermediate said end caps and generally parallel thereto, said baffles defining a low frequency tuning chamber therebetween and defining flow chambers intermediate said baffles and said end caps, an inlet tube extending through said inlet end cap and through both said baffles, the portion of said inlet tubes intermediate said baffles being perforated, a perforated transfer tube extending through both said baffles to provide communication between said flow chambers, an outlet tube disposed intermediate said inlet tube and said transfer tube and extending through both said baffles and through said outlet end cap, the portion of said outlet tube intermediate said baffles being perforated, a generally tubular member of generally eliptical cross section along a major portion of its length surrounding the portion of said outlet tube intermediate said baffles and defining a high frequency tuning chamber therebetween, said eliptically cross-sectional tubular member including orthogonally disposed long and short cross-sectional axes, the long cross-sectional axis of the eliptically cross-sectioned tubular member being generally orthogonal to the long cross-sectional axis of the eliptically cross-sectioned outer shell.

2. A high performance muffler as in claim 1 further comprising a sound absorbing material in the high frequency tuning chamber external to said outlet tube.

3. A high performance muffler as in claim 2 wherein the absorbing material comprises fiberglass.

4. A high performance muffler as in claim 2 wherein the eliptically cross-sectioned tube is of reduced dimensions adjacent the opposed ends thereof to define a mechanical interfit with said outlet tube.

5. A high performance muffler as in claim 4 wherein the reduced dimensions of said generally eliptical tube are formed by a plurality of pinched portions in said opposed ends thereof.

6. A high performance muffler as in claim 1 wherein the outlet end cap includes an outwardly bowed portion of generally spherical shape disposed substantially in line with said inlet tube.

7. A high performance muffler as in claim 6 wherein the outwardly bowed portion of said outlet end cap is spaced from said outlet tube and from said outer shell.

8. A high performance muffler as in claim 6 wherein said outlet end cap further includes a second outwardly bowed portion of generally spherical shape disposed substantially in line with said transfer tube.

9. A high performance muffler as in claim 6 wherein the inlet end cap includes an outwardly bowed portion generally in line with both said outlet tube and said transfer tube.

10. A high performance muffler as in claim 8 wherein said outwardly bowed portion is of generally teardrop shape with a larger dimension generally opposite the transfer tube.

11. A high performance muffler as in claim 8 wherein the outwardly bowed portion in said inlet end cap is spaced from both said inlet tube and said outer shell.

* * * * *